United States Patent [19]

Bode et al.

[11] Patent Number: 4,559,763

[45] Date of Patent: Dec. 24, 1985

[54] DEVICE FOR PRESSING DOWN PRODUCT IN FILLED CONTAINERS WITH OPEN TOPS WHICH CAN BE MOVED CONTINUOUSLY AND WITH PREDETERMINED SPACING

[76] Inventors: Günter Bode, Brockenblick 8, 3341 Ohrum; Horst Meier, Bevenroder Str. 5, 3300 Braunschweig, Fed. Rep. of Germany; Manfred Engler, CArl-Zeiss-Strasse 10, 7100 Heilbronn-Kirchhausen, all of Fed. Rep. of Germany

[21] Appl. No.: 211,874

[22] Filed: Dec. 1, 1980

[51] Int. Cl.[4] ..... B65B 1/24

[52] U.S. Cl. ..... 53/527; 141/123; 53/515

[58] Field of Search ..... 53/527, 515; 141/121, 141/123; 137/625.31; 251/304; 417/457; 166/167, 168, 169

[56] References Cited

U.S. PATENT DOCUMENTS

| | | | |
|---|---|---|---|
| 982,231 | 1/1911 | Barry | 53/367 X |
| 1,513,030 | 10/1924 | Boynton | 166/167 |
| 1,641,480 | 9/1927 | Fleischer | 141/123 |
| 1,673,236 | 6/1928 | Fleischer | 141/121 X |
| 1,963,132 | 6/1934 | Hicks | 141/123 |
| 2,746,663 | 5/1956 | Day et al. | 141/121 X |
| 3,344,894 | 10/1967 | Kenworthy | 137/625.31 X |
| 4,121,400 | 10/1978 | John et al. | 53/527 X |

FOREIGN PATENT DOCUMENTS

| | | | |
|---|---|---|---|
| 7336095 | 1/1974 | Fed. Rep. of Germany . | |
| 2523517 | 11/1976 | Fed. Rep. of Germany | 53/527 |

*Primary Examiner*—Nicholas P. Godici
*Attorney, Agent, or Firm*—Charles E. Brown

[57] ABSTRACT

This relates to an apparatus for forcing fill-goods into a container immediately before the lid is applied to the container. There is provided a tamper head which engages the product to force the solids into the container. Associated with the tamper head is a separately axially moved spring-loaded hood having a tapered lower surface which serves first to align a container with the tamper head, then squeeze off any fill-goods which overlies the rim of the container, and then forms a seal with the container rim to prevent liquid fill-goods from overflowing the container as the projecting fill-goods is pressed into the container. The tamper head has a liquid cavity which opens through the lower part of the tamper head and which is controllably opened to the exterior of the tamper head to receive excess liquid during the pressing in of the fill-goods.

5 Claims, 2 Drawing Figures

Figure 1:
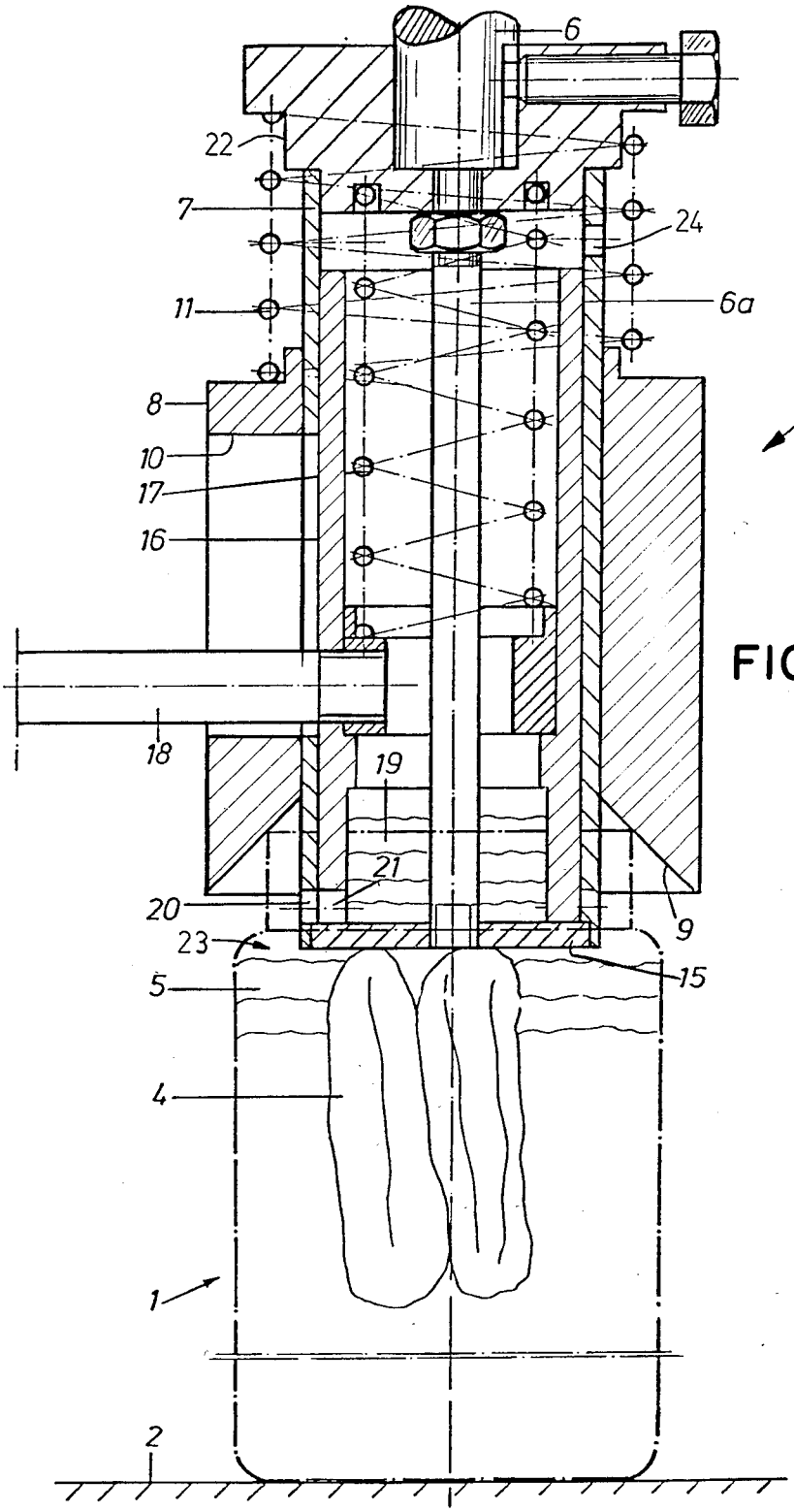

DEVICE FOR PRESSING DOWN PRODUCT IN FILLED CONTAINERS WITH OPEN TOPS WHICH CAN BE MOVED CONTINUOUSLY AND WITH PREDETERMINED SPACING

Apparatus for forcing fill-goods into containers open at the top are known in practice and also in the literature.

German Gebrauchsmuster No. 73 36 095 discloses an apparatus where the containers open at the top are advanced in the filled state at predetermined mutual spacings either along a circular path or in a linear row in continuous manner, while synchronously with the motion of the containers a pushrod to which is solidly mounted a tamper head is actuated with the tamper head dipping into the open container. The tamper head also serves as a lower stop for a disk-shaped squeeze-off component mounted for movement along the pushrod and seating under spring action on the rim of the associated container when the pushrod is being lowered so as to squeeze off parts of the fill-goods projecting above the rim. To facilitate this squeeze-off operation, provision is made that the disk-shaped squeeze-off component carries out additionally a motion relative to the rim of the container. The squeeze-off component has passages for the overrun liquid draining over the squeeze-off component and the container down into a catch-pan from where it is again returned to the filling station. In order to center the containers moved into position by a feed screw with respect to the tamper head, either an additional star-type reel stand seizing the container neck or provided with peripheral seats is used, or else a linearly displaced centering seat and a conveyor equipped with container seating means are provided.

The known apparatus is costly and changing container shapes or sizes requires laborious and time-consuming assembly work. Also, when glass containers are used, the described manner of centering easily results in glass breakage, or, where labeled containers are concerned, damage to the labels.

It is the object of the invention to provide an apparatus which eliminates the deficiencies of the prior apparatus and which new apparatus is of a substantially simpler design, and provides for easy and accurate centering of containers of various shapes and sizes without complex change-over work. Engagement by the apparatus on the outside of the containers is also prevented.

This problem is solved by the squeeze-off component being in the form of a hood overlapping and surrounding the tamper head when the apparatus is in the rest position with the hood being so designed and so mounted with respect to the tamper head that it can be pressed by means of a centering surface flaring downward against the container rim of the container before the tamper head enters the container, i.e. before contact is made by the tamper head with projecting pieces of fill-goods.

The container centering is achieved with respect to the tamper head by parts solidly fixed with respect to the tamper head and centered at the tamper head itself. Additionally synchronously driven parts such as a rotary star-means provided with centering seats or a conveyor having centering seats are thus eliminated. As the centering surface of the hood cooperates only with the rim of the container, the centering function is independent of the container shape. Therefore rectangular containers, elongated oval containers or containers of other shapes can be equally well centered in a reliable manner by the same centering hood, as the rim is circular in all these containers. Because of the downwardly flaring design of the centering surface, the same hood can also be used to precisely center containers of different aperture diameters. Because of this feature, a substantially simpler construction of the apparatus is obtained, as it requires hardly any assembly work when changing over to different shapes or sizes of containers—as would be required in the known apparatus with centering seats, where the seats must be accurately adjusted in shape and size to the kind of container. Because of the conically flaring centering surface, a substantially improved squeeze-off effect is achieved, for the fill-good parts projecting above the container rim, by means of the hood, whereby a relative motion between the container rim and the centering surface of the hood for the purpose of squeezing the projecting fill-goods parts is not mandatory.

The centering surface can be used in an especially advantageous manner as a sealing surface which, when acting on the container rim will ensure in cooperation with the container that the excess liquid will run over the container rim. Appropriately the centering surface is provided to that end with a coating of sealing material such as rubber or the like, to ensure reliable sealing even if there are defects or unevennesses in the rim surface.

The reliable sealing between the centering surface and the container rim provides that the overrun liquid will collect above the tamper head in the area. of the hood when the tamper head is dipped into the container of the container at the top. The excess overrun liquid can be evacuated from this collection area for instance by a conduit guiding the pushrod and issuing into the collection area, which can be connected with a partial-vacuum source as a function of the operation in order to evacuate in the lowest tamper head position a predetermined excess overrun liquid from the area bounded by the hood, while part of the overrun liquid returns into the container when the tamper head is raised to ensure a predetermined filling level.

The tamper head advantageously can also be formed like a container in such a manner that a predetermined amount of the overrun liquid flows through an orifice at a given location or a container aperture into the inside of the tamper head. This excess overrun is carried along when the tamper head is raised and can again be evacuated from the tamper head when same is in a raised position.

However the preferred arrangement is such that when the tamper head is shaped like a vessel, a device for draining the overrun liquid collecting in the tamper head be provided with a valve-controlled intake or discharge orifice for the overrun liquid. Using such a device, a desired amount of overrun liquid can be collected within the vessel-shaped tamper head in the lower range of its descent, where the intake orifice will be automatically closed at the beginning of the rise of the tamper head and will be opened again only after the tamper head has been guided out of the position aligned with a container into a position aligned with a catching pan. The closing and opening motion of the valve-controlled orifices preferably can be effected from the descent and rise motions of the pushrod.

All these cases make sure to prevent soiling and post-cleaning of the container outside surfaces, and that the excess liquid necessarily leaving the container during tamping run down over the container outside into a catch basin, instead ensuring be collected in sealing manner from the tamper head by the hood, and be drained. Thereby the liquid level within the container can still be controlled more accurately in substantial manner, as on one hand the solid pieces of the fill-goods can be forced deeply enough into the container, while on the other hand the overrun liquid displaced in the process can return into the container to ensure an adequate filling level when the tamper head is being raised, as the entire volume above the container rim is sealed with respect to the outside by the hood cooperating with the container rim in a hermetic manner and as the hood will only lift off the container rim after the tamper head already has been guided out of the container.

The invention is explained in further detail below in relation to several schematic drawings of several embodiments.

Figure 2:
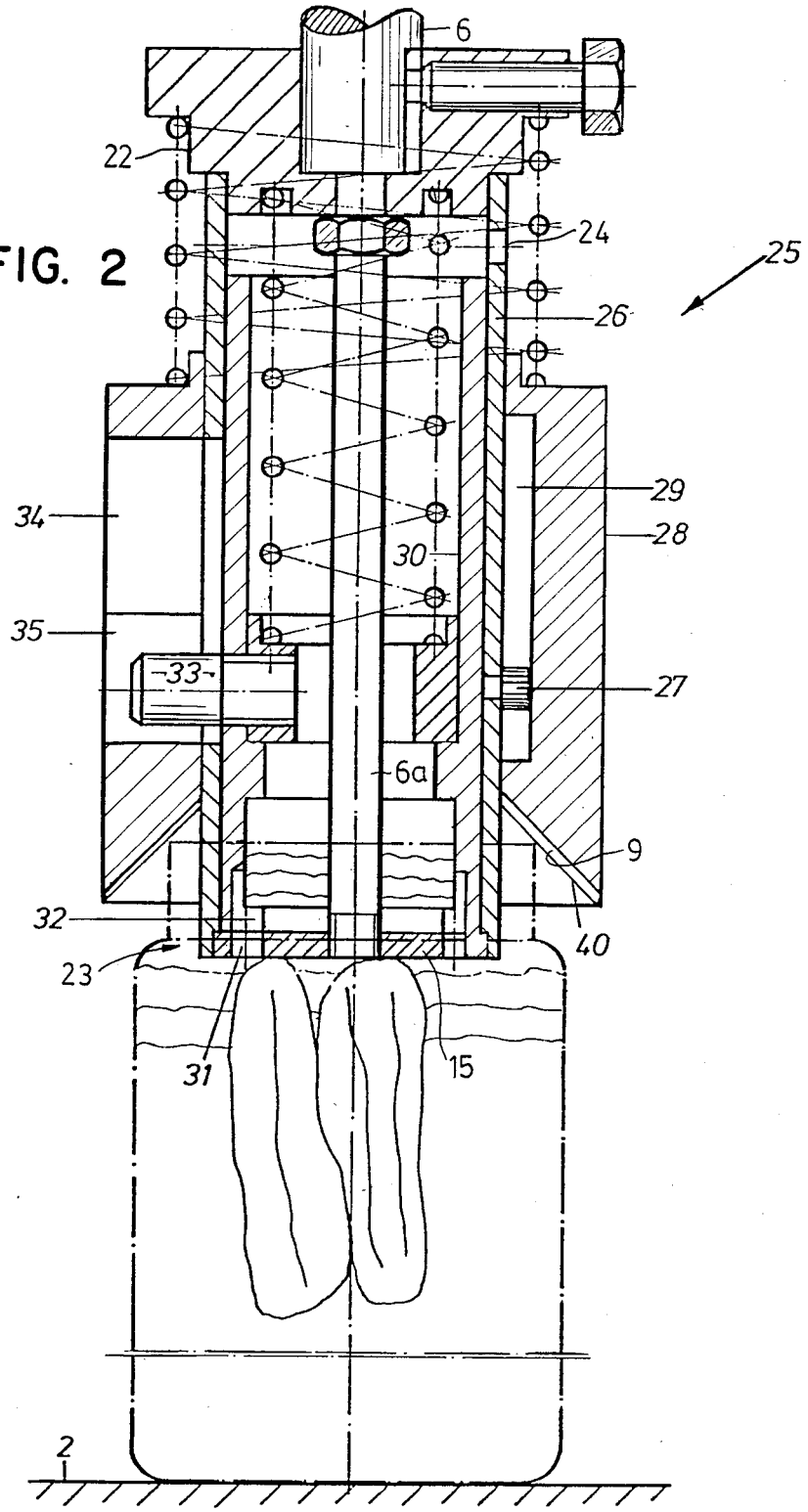

FIG. 1 is a vertical sectional view through one embodiment of the new apparatus, and FIG. 2 is a similar vertical sectional view of a different embodiment.

The drawings show a container 1 in dash-dot lines, which is being advanced linearly or in circular motion by some (omitted) drive means above or together with a support surface 2 in continuous manner. The container has an open mouth defined by a rim. The apparatus 3 cooperating with the container is appropriately so mounted that at least over part of the path followed by the container 1 it moves synchronously with it, so that the operational action of the device can take place during a synchronous motion of container 1 and apparatus 3.

The containers 1, open at the top, are brought forth in the filled condition, solid fill-good pieces 4 and fill-substance liquid 5 filling the container mostly up to the rim and the solid fill-good pieces 4 projecting at least in part axially and/or radially above the container rim. The solid fill-goods pieces must be forced into the container before it is sealed, the fill-goods pieces radially projecting beyond the rim must be squeezed off and a predetermined level of filling-substance liquid in the container must be secured.

The apparatus includes a pushrod 6 which moves up and down and onto which is fixed in detachable manner a pushrod head. The pushrod 6 has a lower pushrod segment 6*a* of lesser diameter extending to the lower end of the apparatus. A hollow cylindrical component 7 is solidly fixed between an upper plate 22, which is detachably connected to the pushrod 6 and a lower tamper head 23; said component is ventilated to the outside by an upper orifice 24 not further detailed. A hood 8 is movably guided on the outer peripheral side of the hollow cylindrical component 7 in the embodiment of FIG. 1. This hood appropriately is made of a ductile plastic. The hood 8 is thick-walled and is provided with a downward flaring centering surface 9 at its lower end face. The slope of the centering surface 9 appropriately is selected in such a manner that when the hood 8 is lowered, the centering surface 9 when impinging upon the circumferential rim of the container can exert a sufficient horizontal force on the container, if the container is off-center, with respect to the axis of the apparatus so as to move the container 1 into a position which is coaxial with the hood 8 as a function of the hood's descending motion. The force required to lower the hood 8 is transmitted from the pushrod 6 through a compression spring 11 to the hood 8, so that the hood can carry out motions which are independent of the pushrod 6 and of the components solidly joined to pushrod 6.

The arrangement is such that for the raised state of the apparatus 3, the hood so overlaps and surrounds the tamper head 23 that the centering surface 9 will be located at an appreciable spacing below the bottom 15 of the tamper head. This spacing is so selected that when the apparatus 3 is lowered onto a filler container, first the centering surface 9 will make contact with fill-goods pieces that might project above the container rim and will either radially displace them toward the center or squeeze them off on account of the slope of the centering surface 9 before the bottom 15 of the tamper head makes contact with axially projecting fill-goods pieces. This ensures that the centering surface 9 always acts in a centering manner on the circumferential rim of the container before the tamper head enters the container, preferably before the bottom 15 of the tamper head makes contact with projecting fill-goods pieces.

Advantageously the centering surface 9 will also be acting as a sealing surface in such a manner that when acting on the rim of the container it will provide a seal for this rim. As shown in FIG. 2, the centering surface 9 can be provided to that end with a coating 40 of a sealing material such as soft rubber or the like.

The sealing of the hood 8 to the container rim before there is contact between the tamper head bottom 15 and the fill-goods ensures that when in the course of the further descent of the pushrod 6 the tamper head bottom 15 forces the fill-goods into the container, the fill-substance liquid so displaced will rise without being able to drain over the container rim and down along the container outside. Rather, the hood bounds a collecting space for excess liquid above the container rim.

In order there be enough room for this liquid, the tamper head 23 is made hollow or like a vessel. Accordingly it forms a collecting space 19 for the overrun liquid which can enter at suitable locations through openings 20,21 (FIG. 1) or 31,32 (FIG. 2) located at the periphery into the inside of the tamper head. The positions of the entry apertures into the vessel-shaped tamper head can be so selected that the relative elevation of entry aperture ensures for the lowest position of the tamper head that a residual amount of the displaced overrun liquid can return into the container again when the tamper head is raised so as to secure therein a predetermined liquid level.

The pushrod 6,6*a* can be designed as a suction line and be provided with an intake orifice issuing into the collecting space 19 directly above the tamper bottom 15. By means of a controlled connection of this suction line with a partial vacuum source, it is then possible to evacuate the liquid accumulating in the collecting space 19 of the tamper head. The evacuation can take place at the lowest position of the tamper head, or else also when the apparatus is in a raised position.

In the illustrative embodiments shown in FIG. 1 and 2, the excess overrun liquid is evacuated without recourse to a suction line. In those embodiments, a control sleeve 16 is mounted in movable manner within the hollow cylindrical component 7 and kept in its lower position by a spring 17. In the embodiment of FIG. 1 the hollow cylindrical component 7 is provided with an aperture 20 at the circumference immediately above the tamper bottom 15, an opening 21 in the control sleeve 16 being aligned with aperture 20 for the position of the apparatus shown in FIG. 1. The control sleeve 16 is provided with an arm 18 radially projecting outward through the peripheral window 10 of the hood 8 and the hollow cylindrical component 7, which cooperates with a cam (not shown) fixed to the structure of the apparatus for the purpose of rotating—at the beginning of the apparatus upward motion—the control sleeve 16 with respect to hollow cylindrical component 7 which is irrotationally secured to the pushrod 6, whereby the openings 20 and 21 lose their alignment and the collecting space 19 will be hermetically sealed. As soon as the apparatus 3 has detached from the container 1, it is lowered again at an intermediate station and in axial alignment above a collecting channel (not shown), the control sleeve 16 being again rotated during the descent by means of a control channel and the control arm 18 into the aligned positions of openings 20,21, whereby the collecting space 19 can drain.

Because the opening and closing motion of the control sleeve 16 with respect to the hollow cylindrical component 7 is only required in the lower range of the descent of the apparatus 3, the control arm 18 when cooperating with an appropriate design of the control channel can be simultaneously utilized to impart a relative rotational motion to the hood 8 in addition to its descending motion, when in the upper range of that descending motion, in order to facilitate squeezing off the fill-goods. No more is required for that purpose than that the control cam moving the control sleeve 16 into the aligned position with respect to the hollow cylindrical component 7 when in the lower range of the descent motion.

In lieu of being solidly fixed to the structure of the apparatus, the control cam also may be mounted into the circumference of the hollow cylindrical component 7, whereby the arm 18 need not radially project outward beyond the hood 8.

The overall design of the apparatus 25 in the embodiment of FIG. 2 is similar to that of the apparatus 3 in FIG. 1. The intake and discharge aperture for the liquid is provided in the bottom of the tamper head to be aligned in axial parallelism at 31 and 32. The centering surface 9 is provided with a sealing coat 40. The hood 28 is free to move in the axial direction with respect to the hollow cylindrical component 26 and is constrained by the hollow cylindrical component 26 with respect to rotational motion. To that end the hollow cylindrical component 26 may be equipped with a guide stud 27 engaging a channel 29 of the hood 28. The channel 29 may extend in axial parallelism, whereby the hood 28 is connected in rotationally secured manner with the hollow cylindrical component 26. However the channel 29 also may follow a path deviating from the predetermined, straight, axially parallel line in order to impart a controlled rotation to the hood 28 with respect to the hollow cylindrical component 26. The hood furthermore is provided with a second control channel 34,35 which is entered by a pin 33 that is solidly mounted to a control sleeve 30. The arrangement is such that upon descent of the apparatus 25, the hood 28 forces the projecting fill-goods inside the container, or squeezes them off, and terminates its axial motion upon setting on the container rim; as the tamper head 23 descends further, the hood 28 acts as a control means for the control sleeve 30 and hence for the valve openings 31,32.

Obviously the arrangement of channels and guide pins can be interchanged.

It is also possible in the arrangement shown in FIG. 2 to impart a rotational motion to the pushrod; this rotational motion is transmitted by the torque-coupling that exists between the hollow cylindrical component 26 and hood 28.

We claim:

1.

Apparatus for forcing fill-goods into open top containers filled with fill-goods of the type including solids and wherein each container has a rim defining an open mouth with said solids projecting at least axially beyond said rim, conveyor means for continuously moving said filled containers generally at predetermined spacing along a preselected path, said apparatus comprising a pushrod lowered and raised synchronously with the movement of the containers past said apparatus, a tamper head fixedly secured to said pushrod for movement with said pushrod into and out of mouths of said containers, and a squeeze-off component carried by said pushrod for axial movement relative to said pushrod and against a prestressed spring action for seating on container rims when said pushrod is lowered; said squeeze-off component being in the form of a hood extending axially below and circumferentially surrounding said tamper head when said apparatus is in a rest position with said pushrod raised, said hood having a lower centering surface flaring in a downward direction for engagement with a container before said tamper head enters the container, the projection of said hood below said tamper head being such that said centering surface will engage the container rim to center the container before the tamper head engages fill-goods projecting out of said container, said center surface on said hood having sealing means for forming a liquid tight seal with a container rim, said tamper head having an interior defining a collecting vessel for excess fill-goods liquid, said tamper head having intake aperture means in a lower part thereof for receiving and trapping liquid when said tamper head is within a container, said intake aperture means including relatively rotatable members each having an aperture therethrough with said apertures being aligned in first positions of said members and misaligned in closing relation in a second position of said members.

2. Apparatus according to claim 1 together with means for effecting said relative rotation of said members in response to lowering and raising of said tamper head.

3. Apparatus according to claim 2 wherein one of said members is an external part of said tamper head and the other of said members is a relatively rotatable valve sleeve telescoped within said tamper head.

4. Apparatus according to claim 1 wherein said means for effecting relative rotation of said members also forms means for effecting rotation of said hood relative to an associated container rim.

5. Apparatus for forcing fill-goods into open top containers filled with fill-goods of the type including solids and wherein each container has a rim defining an open mouth with said solids projecting at least axially beyond said rim, conveyor means for continuously moving said filled containers generally at predetermined spacing along a preselected path, said apparatus comprising a pushrod lowered and raised synchronously with the movement of the containers past said apparatus, a tamper head fixedly secured to said pushrod for movement with said pushrod into and out of mouths of said containers, and a squeeze-off component carried by said pushrod for axial movement relative to said pushrod and against a prestressed spring action for seating on container rims when said pushrod is lowered; said squeeze-off component being in the form of a hood extending axially below and circumferentially surrounding said tamper head when said apparatus is in a rest position with said pushrod raised, said hood having a lower centering surface flaring in a downward direction for engagement with a container before said tamper head enters the container, and means for effecting rotation of said hood in response to lowering and raising of said pushrod.

* * * * *